United States Patent [19]

Uherek et al.

[11] Patent Number: 4,501,344

[45] Date of Patent: Feb. 26, 1985

[54] SPEED PATTERN GENERATOR FOR AN ELEVATOR CAR

[75] Inventors: Vladimir Uherek, Troy Hills Township, Morris County; Matthew F. Kersen, Union, both of N.J.

[73] Assignee: Westinghouse Electric Corp., Pittsburgh, Pa.

[21] Appl. No.: 523,994

[22] Filed: Aug. 17, 1983

[51] Int. Cl.[3] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 4,102,436 | 7/1978 | Kernick et al. | 187/29 |
| 4,128,142 | 12/1978 | Satoh et al. | 187/29 |
| 4,136,758 | 1/1979 | Tachino | 187/29 |
| 4,337,847 | 7/1982 | Schröder et al. | 187/29 |
| 4,354,576 | 10/1982 | Kajiyama | 187/29 |

FOREIGN PATENT DOCUMENTS

| | | | |
|---|---|---|---|
| 54-153459 | 12/1979 | Japan | 187/29 |

*Primary Examiner*—J. V. Truhe
*Assistant Examiner*—W. E. Duncanson, Jr.
*Attorney, Agent, or Firm*—D. R. Lackey

[57] ABSTRACT

A method of generating a landing speed pattern which starts with the dynamics of the actual elevator system and the desired actual landing velocity profile curve, and generates a landing speed pattern which will produce the desired actual landing velocity characteristic. In a preferred embodiment, the actual desired landing velocity is a function of time squared, defining a parabolic profile. The apparatus includes arrangements for implementing a predetermined speed pattern equation in response to the distance-to-go count (DTG) of predetermined standard increments to the target floor.

10 Claims, 14 Drawing Figures

SPEED PATTERN GENERATOR FOR AN ELEVATOR CAR

BACKGROUND OF THE INVENTION

1. Field of the Invention

The invention relates in general to elevator systems, and more specifically to speed pattern generators for an elevator car.

2. Description of the Prior Art

The speed of an elevator car is normally controlled by a speed pattern in a traction elevator system. The speed pattern includes four major portions: acceleration, full speed, deceleration, and landing. The landing speed pattern provides the transition between full or maximum deceleration to zero deceleration. The landing speed pattern can be generated digitally from the distance-to-go (DTG) or by analog devices such as hatch inductors or transducers.

A linear landing pattern would provide the fastest landing. However, it would land the car at full deceleration and zero velocity, and the rapid change from full deceleration to zero deceleration would provide a large jerk which would greatly exceed the maximum passenger comfort level. Thus, the landing speed pattern which is usually used in exponential in nature, with the DTG being an exponential function of time, starting from the point at which the landing is initiated, as expressed by the following relationship:

$$DTG = Ke^{-t/\tau} \quad (1)$$

where:

t = time $\tau$ = a time constant related to the selected landing distance, and the selected velocity at that distance.

The car velocity, acceleration and jerk during landing can be derived from equation (1) by taking successive derivatives thereof, and they are also exponential in nature.

During acceleration the actual speed of the elevator car lags the speed pattern, and during deceleration and landing the actual speed is greater than the speed pattern, because of the system time delay. The closed loop speed transfer function of an elevator motor controller can be approximated by a slightly underdamped second order system which will follow a time ramp with a constant delay of T, which is normally about 0.25 sec.

Since the landing pattern is lagging the car landing velocity, the landing pattern can be expressed as:

$$P(t) = v(t) - a(t)T \quad (2)$$

where:

P = landing pattern v = car velocity a = deceleration rate

T = system lag to a ramp input

A landing speed pattern derived from equation (2) provides a reasonably good landing and a comfortable ride for the passengers. However, it does have some disadvantages. Being exponential in nature, the landing speed pattern produces a non-zero final car speed, and it requires in excess of two seconds to land the car.

SUMMARY OF THE INVENTION

Briefly, the present invention is a new and improved landing pattern generator for an elevator car, and new and improved methods of generating a landing speed pattern. The disadvantages of the prior art landing speed patterns are overcome by methods and apparatus which generate a speed pattern which causes the elevator car, in response thereto, to land with a speed or velocity having a parabolic profile. In other words, the actual landing speed is responsive to time squared. It is important to note that it is the actual car landing speed which has a parabolic profile, not the landing pattern per se. The parabolic landing velocity lands the car in a shorter distance and in less time then an exponential pattern, as it lands the car with a constant jerk rate at the maximum jerk allowed for the system. This produces a zero velocity and zero acceleration precisely at floor level, saving about one full second in landing time, compared with an exponential landing speed pattern. Also, for a given landing distance and time to land, the constant jerk rate of the parabolic landing is less than the maximum jerk produced during the variable jerk rate of an exponential landing.

The new method includes deriving the landing speed pattern from the desired landing speed velocity, and it takes into consideration the dynamics of the elevator system the speed pattern is developed for. The new apparatus includes different arrangements for implementing the speed pattern developed from the new method, including calculating the landing speed pattern from the DTG, and using the DTG to address a read-only memory (ROM) which has the digital values of the landing pattern precalculated and stored therein.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

The invention relates to new and improved speed pattern generator apparatus for an elevator system, and methods of generating a speed pattern for an elevator system. The new and improved speed pattern generator, and methods of generating a speed pattern, are described by illustrating only those parts of an elevator system which are pertinent to the understanding of the invention, with the remaining portions of a complete elevator system being incorporated by reference to a copending patent application and to issued patents assigned to the same as the present application. Accordingly, application Ser. No. 446,149 filed Dec. 2, 1982, entitled "Speed Pattern Generator for an Elevator Car", U.S. Pat. Nos. 3,750,850; 4,277,825; 3,902,572; and 4,019,606 are incorporated into the specification of the present application by reference. Application Ser. No. 446,149 describes a complete speed pattern generator which includes all of the phases of a complete pattern. The landing speed pattern of the present application may be used for the landing speed pattern phase of the speed pattern in the incorporated application. U.S. Pat. No. 3,750,850 sets forth a car controller, including a floor selector and a speed pattern generator. The speed pattern generator of application Ser. No. 446,149 may be substituted for the speed pattern generator of the U.S. Pat. No. 3,750,850 patent. U.S. Pat. No. 4,277,825 discloses elevator drive machine control which may utilize the speed pattern generated by the speed pattern generator of the invention to control the speed of the elevator car. U.S. Pat. Nos. 3,902,572 and 4,019,606 illustrate cam/switch, and optoelectronic arrangements, respectively, which may be used to detect when the elevator car is in the landing zone of a floor, and when it is substantially level with a floor.

Figure 1:
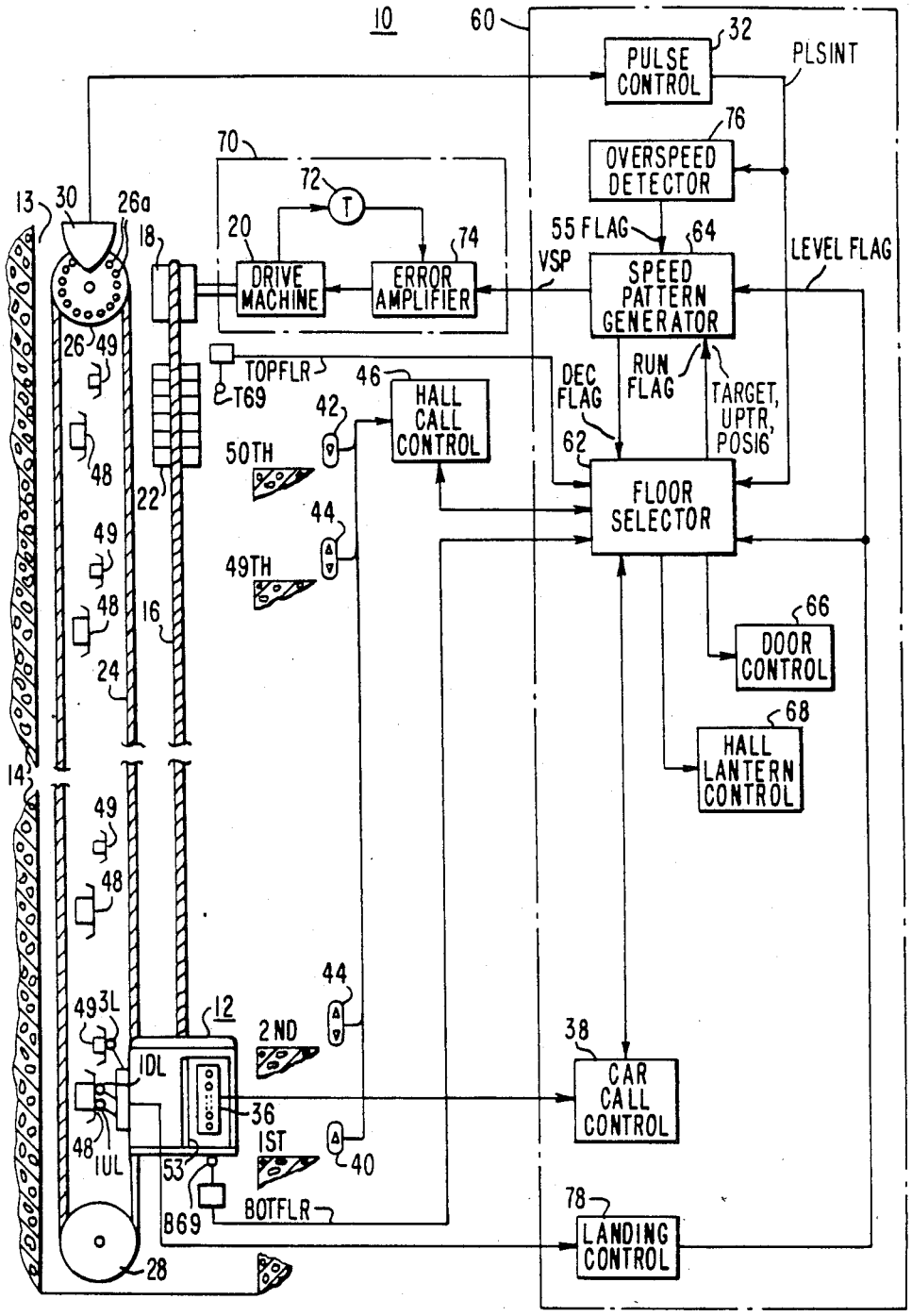
FIG. 1 is a schematic diagram of an elevator system which may utilize the teachings of the invention.

FIG. 1 illustrates an elevator system which may utilize the teachings of the invention. Elevator system 10 includes an elevator car 12, the movement of which is controlled by a car controller 60. The car controller 60 includes a floor selector 62 and a speed pattern generator 64. The floor selector 62 is described in detail in incorporated U.S. Pat. No. 3,750,850. It is sufficient for the understanding of the present invention to state that the floor selector 62, in addition to providing signals for door control 66 and hall lantern control 68, provides signals RUN TARGET and UPTR for the speed pattern generator. The signal RUN is true when the floor selector 62 detects a need for elevator car 12 to make a run, and this signal will be referred to as the RUN flag. TARGET is the floor height in binary of the next stop for the elevator car. The pattern generator compares the AVP floor with TARGET to determine when the slowdown phase of a run should start. The AVP floor is the closest floor ahead of the elevator car at which it may make a normal stop. Signal UPTR is the travel direction signal prepared by the floor selector 62, with UPTR being a logic one for the up-travel direction, and a logic zero for the down-travel direction.

Car 12 is mounted in a hatchway 13 for movement relative to a structure 14 having a plurality of landings. Car 12 is supported by a plurality of wire ropes 16 which are reeved over a traction sheave 18 mounted on the shaft of a drive machine 20. The drive machine 20, along with its associated closed loop feedback control, is referred to generally as drive machine control or motor control 70. Motor control 70, which is shown in detail in incorporated U.S. Pat. No. 4,277,825, includes a tachometer 72 and an error amplifier 74.

A counterweight 22 is connected to the other ends of the ropes 16. A governor rope 24, which is connected to the car 12, is reeved over a governor sheave 26 located above the highest point of travel of the car 12 in the hatchway 13, and under a pulley 28 located at the bottom of the hatchway. A pick-up 30 is disposed to detect movement of the elevator car 12 through the effect of circumferentially-spaced openings **26*a* in the governor sheave 26, or in a separate pulse wheel which is rotated in response to the rotation of the governor sheave. The openings 26*a* are spaced to provide a pulse for each standard increment of travel of the elevator car 12, such as a pulse for each 0.25 inch of car travel. Pick-up 30 may be of any suitable type, such as optical or magnetic. Pick-up 30 is connected to pulse control 32 which provides distance pulses PLSINT for the floor selector 62. Distance pulses may be developed in any other suitable manner, such as by a pick-up disposed on the elevator car 12 which cooperates with a coded tape disposed in the hatchway, or other regularly spaced indicia in the hatchway. The distance pulses may also be used by an overspeed detector 76**.

Car calls, as registered by pushbutton array 36 mounted in the car 12, are processed by car call control 38, and the resulting information is directed to the floor selector 62.

Hall calls, as registered by pushbuttons 40, 42 and 44 located in the hallways, are processed in hall call control 46. The resulting processed hall call information is directed to the floor selector 62.

Figure 4:
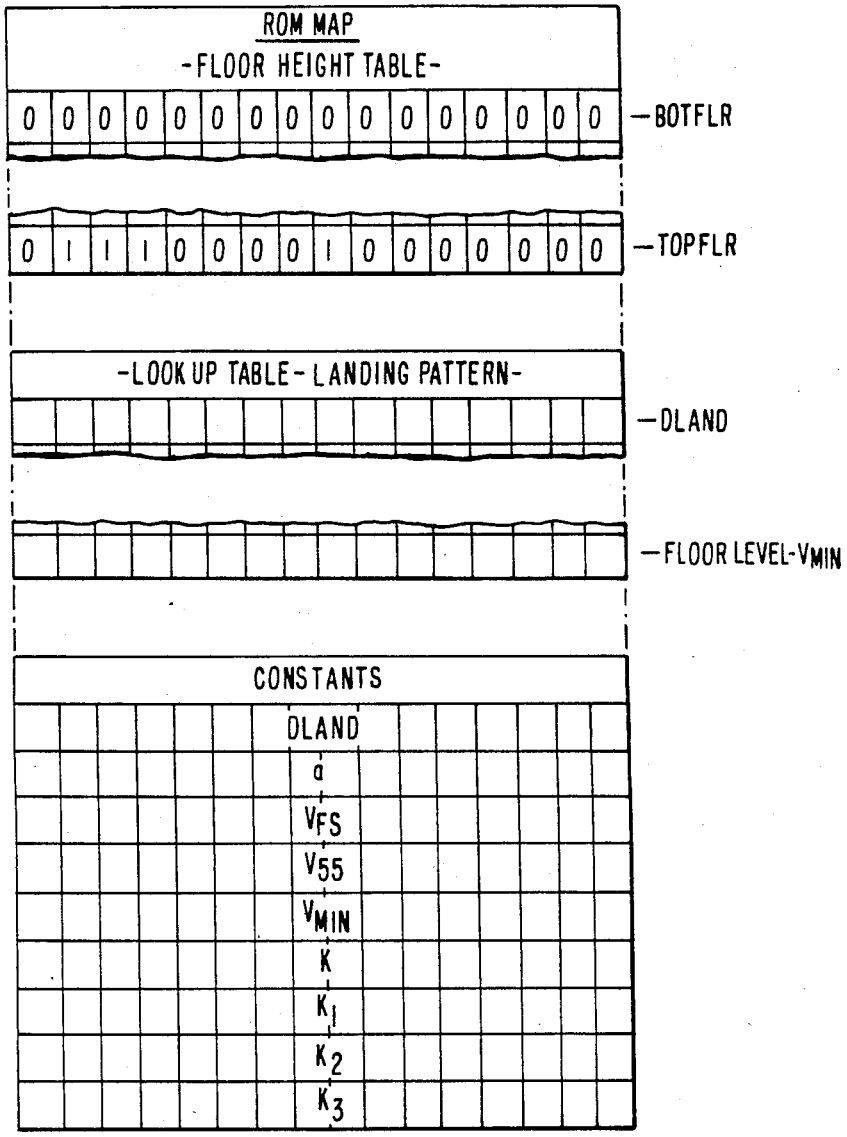
FIG. 4 is a ROM map which sets forth certain tables and constants stored in ROM.

The floor selector 62 tabulates the distance pulses from the pulse detector 32 in an up/down counter to develop a count POS16 concerning the precise position of the car 12 in the hatchway 13, to the resolution of the standard increment. The POS16 count when the car 12 is level with each floor of the building is used as the address for the associated floor. These floor-height values are stored in a look-up table (FIG. 4), which is indexed by the car's AVP. The speed pattern generator 64 also uses the POS16 count.

The floor selector 62, in addition to keeping track of the position of the car 12, also tabulates the calls for service for the car, and it provides signals for starting the elevator car on a run to serve calls for elevator service. The floor selector 62 also develops an advanced floor position for the elevator car 12, referred to as the AVP floor. As hereinbefore stated, the advanced floor position AVP is the closest floor ahead of the elevator car 12 in its travel direction at which the car can stop according to a predetermined deceleration schedule. The floor at which the car 12 should stop, to serve a car call or a hall call, or simply to park, is referred to as the target floor. The floor selector 62 provides the binary address TARGET of the target floor, which is used by the speed pattern generator 64. Floor selector 62 also controls the resetting of the car calls and hall calls when they have been serviced.

Accurate leveling of the car 12, and releveling, at each floor may be accomplished by leveling switches 1DL and 1UL mounted on the elevator car 12, which cooperate with leveling cams 48 at each floor, as described in incorporated U.S. Pat. No. 3,902,572. A flag LEVEL is set when the need for releveling is detected. A switch 3L mounted on the car 12 and cams 49 mounted in the hoistway may be used to determine when the elevator car is a predetermined distance from a floor, such as ten inches. Alternatively, the optoelectronic arrangement of U.S. Pat. No. 4,019,606 may be used to provide such position signals.

Figure 2:
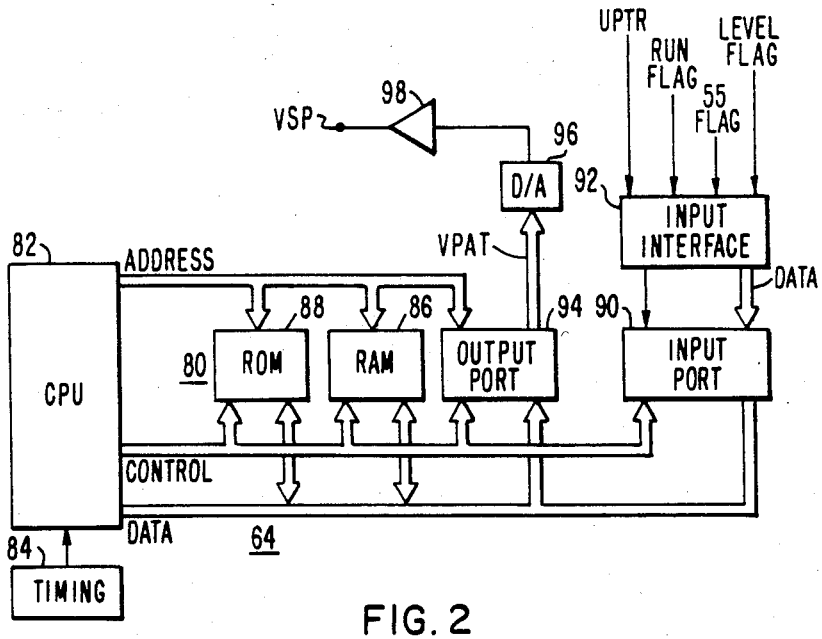
FIG. 2 is a schematic diagram of a microcomputer which may be used to implement the teachings of the invention.

The speed pattern generator 64 of the present invention is preferably implemented by a digital computer, and more specifically by a microcomputer. FIG. 2 is a schematic diagram of a microcomputer arrangement 80 which may be used. As hereinbefore stated, all of the functions of the car controller 60 may be implemented by a single microcomputer 80, which simplifies the communication between the floor selector and speed pattern generator functions, as they may use a common random access memory (RAM). However, since the present invention relates to the speed pattern function, it simplifies the description to merely state what signals the speed pattern generator receives from other functions, and to refer to patents or patent applications for apparatus which can provide such signals.

Microcomputer 80 includes a central processing unit (CPU) 82, system timing 84, a random access memory (RAM) 86, a read-only memory (ROM) 88, an input port 90 for receiving signals from external functions via a suitable interface 92, an output port 94 to which the digital speed pattern signal is sent, a digital-to-analog (D/A) converter 96, such as Analog Devices 565, and an amplifier 98 which provides the analog speed pattern signal VSP. The microcomputer 80, for example, may be INTEL's iSBC80/24 TM single board computer. With this computer, the CPU would be INTEL's 8085A microprocessor, the timing function 84 would include INTEL's clock 8224, and the input and output ports would be on-board ports.

The actual car position POS16 may be maintained by a solid state, binary up/down counter, and/or the floor selector function may be provided by the microprocessor 80 shown in FIG. 2. If the latter, the microprocessor 80 may maintain a counter in RAM 86 for maintaining the car position, which count will be referred to as POS16.

Figure 3:
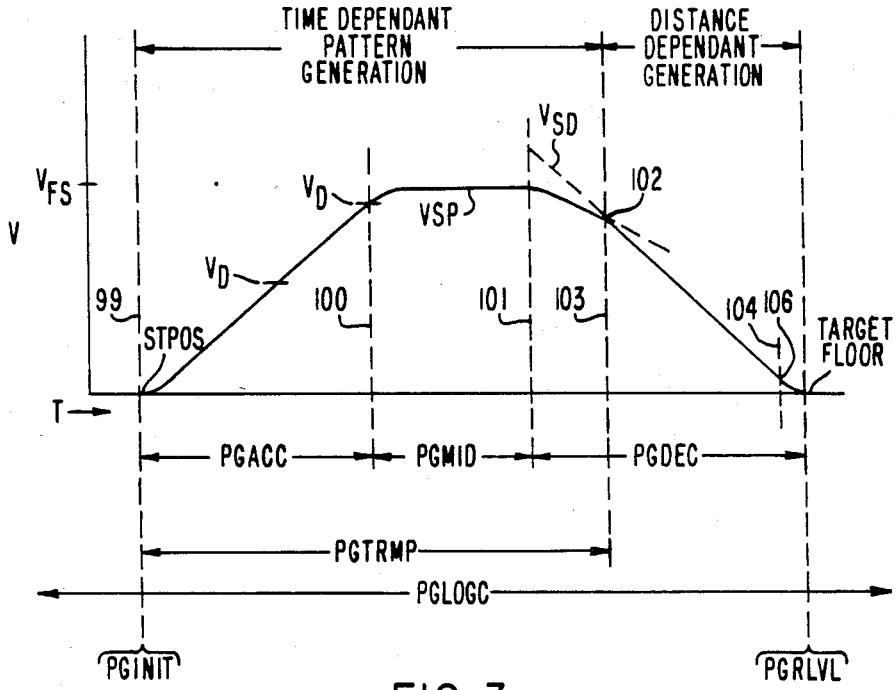
FIG. 3 is a graph which illustrates a speed pattern and the functional modules which are called by a supervisory or logic module to control various portions of the speed pattern.

A typical speed pattern VSP is shown in FIG. 3. It starts at STPOS, indicated by broken vertical line 99, which is the starting position of the elevator car 12 in terms of the count POS16. The speed pattern, which is initially a time based pattern, then increases in a jerk limited manner until the AVP floor of the car 12 reaches the level of the target floor, or the acceleration rate reaches a predetermined maximum value, whichever comes first. Typically, the former occurs first only on a short-floor run. If constant acceleration is reached before the car's AVP reaches the target floor, the pattern VSP will increase with a predetermined constant acceleration a, such as 3.75 ft/sec$^2$ until the car's AVP reaches a target floor, or a calculated decision speed $V_D$ of the speed pattern reaches a predetermined value $V_{FS}-K$, whichever comes first. If the value $V_{FS}-K$ is reached by $V_D$ before the car's AVP reaches the target floor, the acceleration is reduced to zero, starting at broken vertical line 100, in a jerk limited manner. The value of the constant K is selected such that the pattern will smoothly change from the linearly increasing speed value to a constant rated speed value $V_{FS}$.

The speed pattern VSP continues at the constant magnitude $V_{FS}$ until the car's AVP reaches the target floor, at which point, indicated by broken vertical line 101, a distance dependent speed pattern $V_{SD}$ is generated simultaneously with the time based pattern VSP. Pattern $V_{SD}$ has an acceleration rate of $-a$, i.e., deceleration, and its starts as shown by the broken line showing in the figure. The time based pattern is changed in a jerk limited manner from zero acceleration to $-0.75$ a, to cause it to quickly cross pattern $V_{SD}$, as disclosed in U.S. Pat. No. 4,373,612, which is assigned to the same assignee as the present application. When they cross at this high speed transfer point 102, through which broken vertical line 103 passes, pattern $V_{SD}$ is substituted for the time based pattern, and pattern $V_{SD}$ becomes the speed pattern VSP which is output to the error amplifier 74. The speed pattern reduces at the constant rate $-a$ until car 12 reaches a predetermined distance DLAND from the target floor, represented by broken vertical line 104. As will be hereinafter explained, the distance DLAND would be predetermined from equation (17). The speed pattern from this low speed transfer point to the floor level may be provided by a separate analog signal generator, which would be substituted for pattern VSP at low speed transfer point 106. Such an analog generator may be provided by a hatch transducer, or the car position count POS16 from the low speed transfer point to floor level may be used to address a ROM which will output a digital pattern, providing a different value for each 0.25 inch of car movement. This digital pattern would be sent to the D/A converter 96. According to the teachings of the invention, the landing pattern, whether digital or analog, is arranged to cause the car landing speed to have a parabolic configuration.

The speed pattern generator 64 includes a plurality of function modules, each of which controls a specific portion of the speed pattern VSP. The function modules are under the control of a supervisory or logic module referred to as module PGLOGC. As illustrated in FIG. 3, module PGLOGC is periodically run throughout the entire run of the elevator car 12, as well as when the elevator car 12 is standing at a floor. When the floor selector 62 determines that a run should be made and sets the flag RUN, module PGLOGC calls a function module PGINIT. This module initiates the speed pattern and enables a module PGTRMP by setting a flag TREN. Module PGTRMP provides a time ramp function, and its output provides the time dependent portion of the speed pattern VSP. Module PGINIT sets a flag ACCEL. When module PGLOGC runs again, it will call a function module PGACC, because flag ACCEL is now set. Module PGINIT sets the desired maximum acceleration rate for the time ramp generator module. At the proper time, module PGACC sets the desired acceleration to zero. This occurs when the car's AVP reaches the target floor, or when the pattern magnitude $V_D$ reaches $V_{FS}-K$. Module PGACC then calculates the car slowdown distance SLDN, and it sets a flag MIDRN. Module PGLOGC calls a module PGMID the next time it runs, in response to flag MIDRN being set. Module PGMID uses the distance SLDN to determine when the car 12 is located the distance SLDN from the AVP floor. When it detects that the car has reached the distance SLDN from the AVP floor, and the AVP floor is the target floor, it sets the desired acceleration for the module PGTRMP to −0.75 a, and it sets a flag DECEL. The next time module PGLOGC runs, it will call a function module PGDEC as a result of flag DECEL being set. Module PGDEC calculates the digital slowdown pattern $V_{SD}$ and it detects when the time based portion of the pattern crosses the distance based portion $V_{SD}$. At the crossing point 102, module PGDEC disables the module PGTRMP, and it substitutes the distance based pattern for the time based pattern. When the car 12 reaches the landing distance DLAND from the target floor, module PGDEC provides a landing speed pattern. If releveling is required, module PGLOGC calls a module PGRLVL, which provides a releveling speed pattern. Another module PGSFLR is also callable by module PGLOGC when the distance between the starting position of the elevator car and the target floor is less than a predetermined value, such as four feet. Module PGSFLR provides the speed pattern for this "short run".

Each floor of the building is assigned a binary value corresponding to its height or distance from the lowest travel point in the building, with the binary value being in the terms of the standard increment. The binary value for each floor is maintained in a floor height table, indexed by the car's AVP, stored in ROM 88, with FIG. 4 being a ROM map which sets forth a suitable format for the floor height table. Also, as will be hereinafter explained, ROM 88 may include a look-up table for obtaining a landing pattern determined according to the teachings of the invention. ROM 88 will also include certain of the constants used by the function modules.

Figure 5:
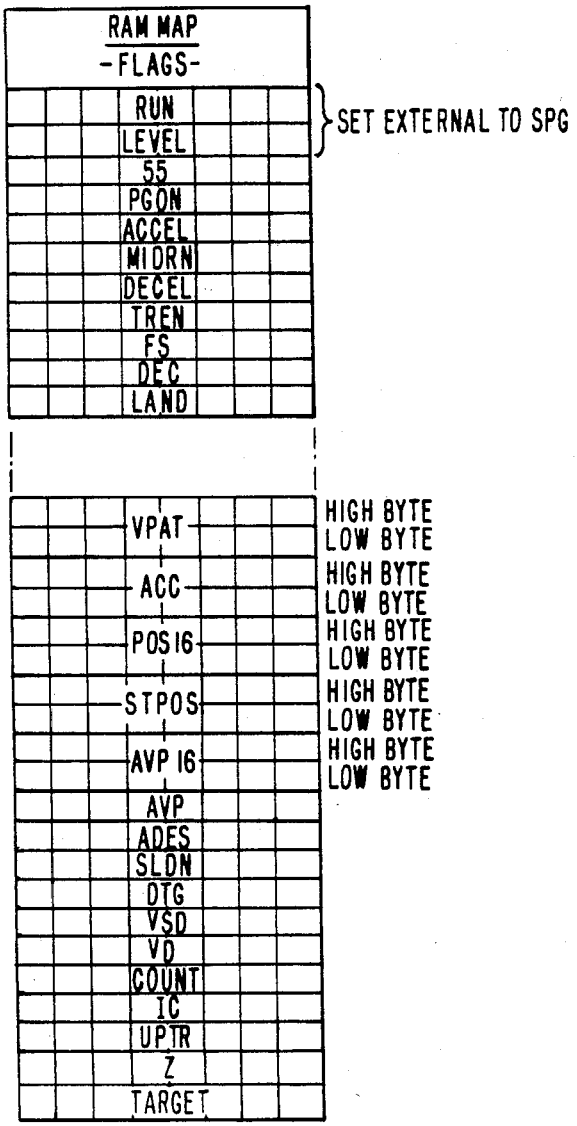
FIG. 5 is a RAM map which sets forth certain flags and program variables stored in RAM.

FIG. 5 is a RAM map which sets forth suitable formats for certain data which may be stored in RAM 86, including the flags RUN, LEVEL and an overspeed flag 55, which flags are set externally to the speed pattern generator. RAM 86 also includes flags which are set and reset by the pattern generator function modules, as well as a plurality of other signals and program variables.

Figure 6:
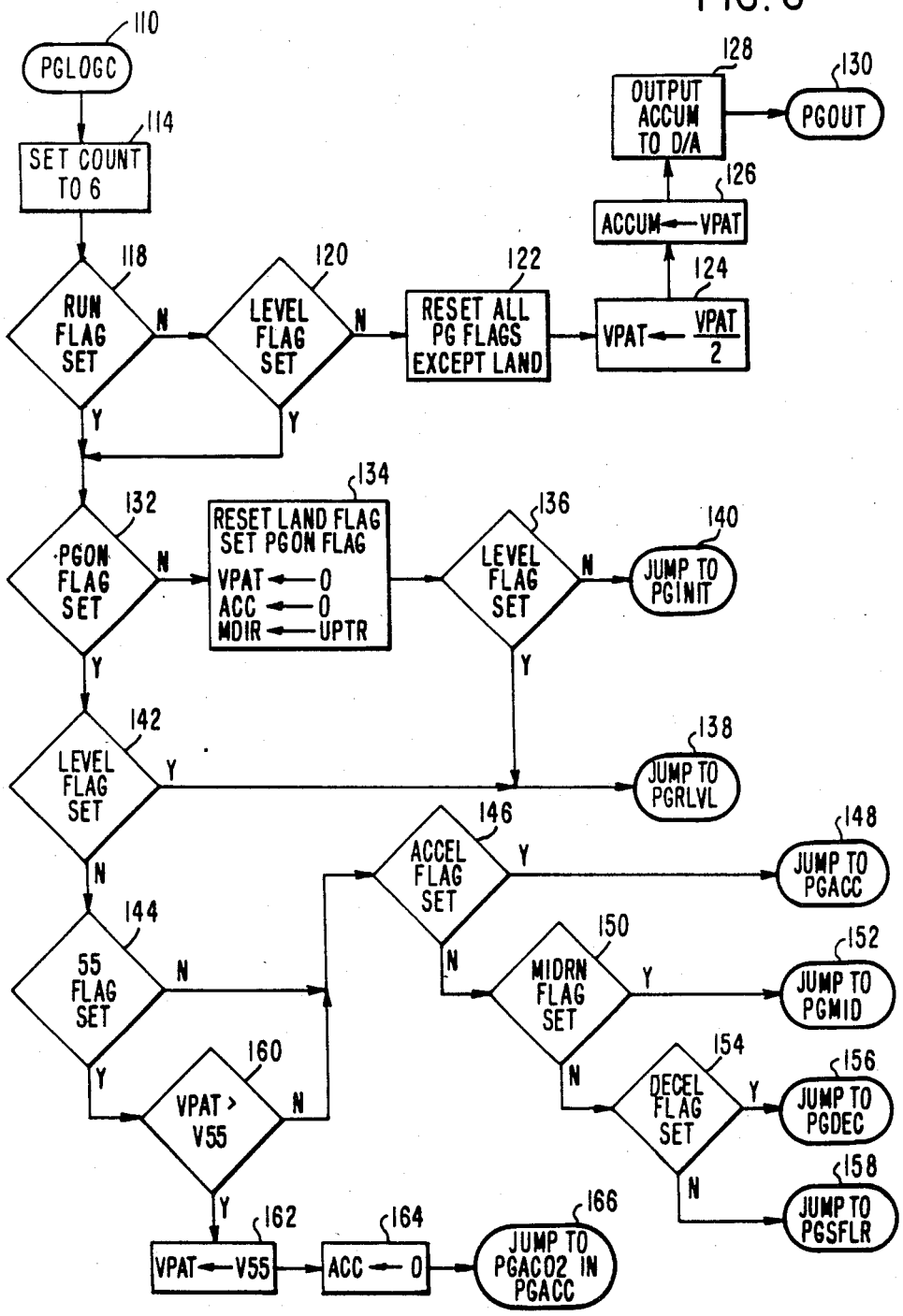
FIG. 6 is a flow chart of a supervisory control or logic module PGLOGC which runs periodically to interpret commands made to the pattern generator, to determine the current status of the pattern generator, and to transfer control to a function module which handles the function required of the pattern generator at any given time.

FIG. 6 is a detailed flow chart of the supervisory or logic module PGLOGC which is stored in ROM 88 and periodically run to: (a) interpret commands to the speed pattern generator 64, (b) determine the current status of the pattern generator, and (c) to transfer control to the function module which handles the specific function required of the pattern generator at any given time.

The time ramp generator module PGTRMP is run in response to time interrupts, such as an interrupt every 4.167 MS, or 240 times per second. Program PGLOGC need not run that often during the time based phase of the speed pattern, as it only provides parameters for PGTRMP, and is not responsible for producing the pattern per se. Thus, the program for module PGTRMP may count the interrupts and compare the interrupt count IC with a value stored at a location COUNT in the RAM map of FIG. 5. When the interrupt count IC reaches the value of COUNT, such as six, then module PGLOGC may be run. When the distance based portion of the speed pattern is operative, module PGLOGC calls the module PGDEC to produce actual points on the speed pattern curve. Thus, when the pattern reaches this phase, module PGLOGC should be run more often in order to produce a pattern having the desired precision. Accordingly, module PGLOGC may be run every second interrupt during the distance based phase of the speed pattern, for example.

Module PGLOGC is entered at a starting address referenced 110, and step 114 sets COUNT to 6. Step 118 checks the flag RUN in RAM 86 to see if the floor selector 62 is requesting that the elevator car 12 begin a run. If RUN is not set, step 120 checks the flag LEVEL to see if landing control 78 is requesting releveling. If flag LEVEL is not set, step 122 resets all flags except LAND, which maintains stretch-of-rope releveling active, and any speed pattern value is reduced to zero in steps. The digital pattern value is referred to as VPAT, and it is stored in RAM 86 as a two byte value, with only the top 12 bits being significant as far as the value of the speed pattern is concerned. Any speed pattern value is reduced to zero in steps by program steps 124, 126 and 128, as the module PGLOGC is run repeatedly, even when the speed pattern is not being generated, in order to detect commands addressed to the speed pattern generator. Step 124 divides VPAT by two, the new value of VPAT is output to the accumulator of a microcomputer in step 126, step 128 outputs the value in the accumulator to the D/A converter 96 via the output port 94, and the program returns to an interrupted program, or to a priority executive, at exit 130.

Figure 7:
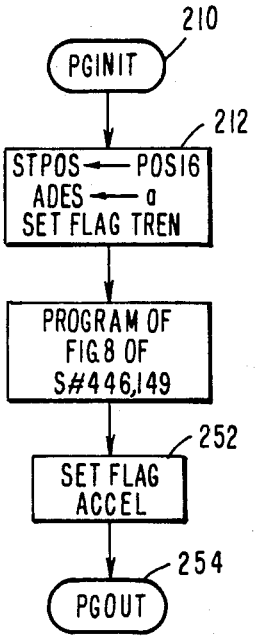
FIG. 7 is a flow chart of a program module PGINIT which is called at the start of a run of the elevator car to initiate the speed pattern, and which is also utilized during certain portions of the run.

If an actual run is being requested by floor selector 62, step 118 will find the flag RUN set, step 132 will not find flag PGON set, and the program follows steps 134 and 136 to step 140, which transfers control to program module PGINIT shown in FIG. 7. Module PGINIT will initiate the speed pattern. and six interrupts latter, step 132 will find flag PGON set and thus will not transfer control to module PGINIT.

Step 132 then proceeds to step 142, which will not find flag LEVEL set, and step 144 checks flag 55 controlled by the overspeed detector 76. Since this is the very start of a run, step 144 will not find flag 55 set and step 146 checks to see if the flag ACCEL has been set. As shown in FIG. 7, module PGINIT sets flag ACCEL in step 252 when it runs at the start of the initiation of the speed pattern, and thus step 146 transfers control to module PGACC at step 148.

Figure 8:
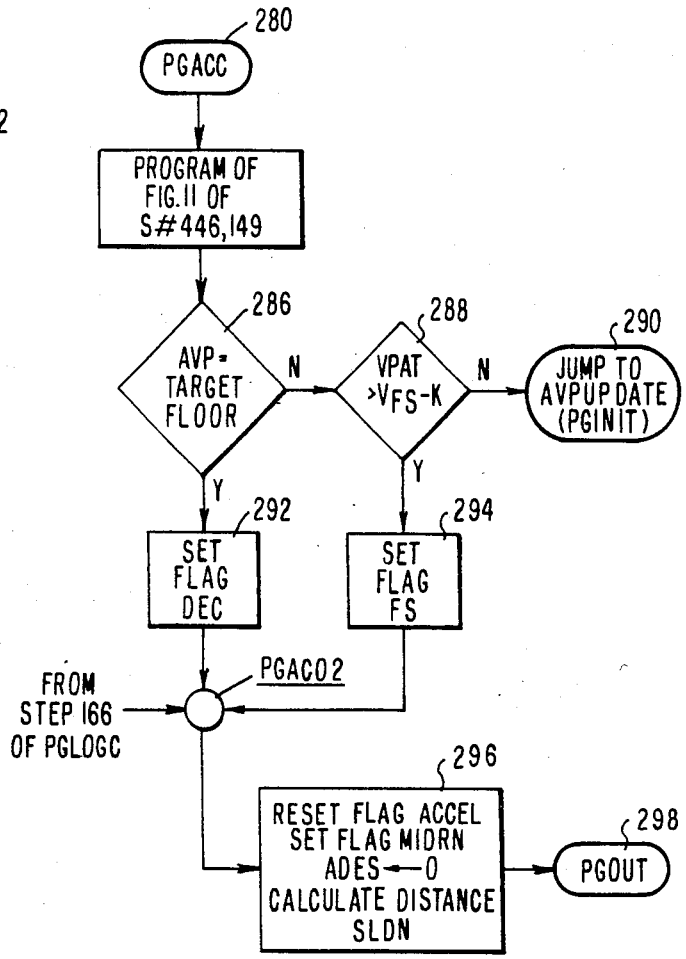
FIG. 8 is a flow chart of function module PGACC which is called by module PGLOGC during the acceleration phase of the run.

When module PGACC no longer has a need to run, it resets flag ACCEL and it sets flag MIDRN, as shown in step 296 of FIG. 8. After this happens, step 146 will go to step 150 which checks flag MIDRN. Since flag MIDRN is now set, module PGLOGC transfers control to module PGMID in step 152. When program PGMID no longer has a need to run, it will reset flag MIDRN and it will set flag DECEL, as shown in step 344 of FIG. 9. After this happens, step 150 will proceed to step 154 to check flag DECEL, and step 154 will advance to step 156 which transfers control of the speed pattern generator to module PGDEC shown in FIG. 10.

If program PGINIT finds that a short run is to be made, it will jump to a module PGSFLR. Flags ACCEL, MIDRN, and DECEL will not be set. Thus, on the next running of PGLOGC, step 132 will find flag PGON set and proceed to step 158 via steps 142, 144, 146, 150 and 154. Step 158 returns to the module PGSFLR.

The overspeed detector 76 is set to a first level of overspeed detection. If it detects the car speed exceeding this first level, it sets flag 55 and module PGLOGC will detect this in step 144. Step 160 then checks to see if VPAT, the digital value of the speed pattern, exceeds V55, the digital value to which the pattern should be clamped when flag 55 is set, which value is stored in ROM 88. This value may typically be about 85% of contract speed. If VPAT exceeds V55, steps 162 and 164 clamp the pattern to V55 and reduce the pattern acceleration to zero, respectively.

Model PGINIT, shown in FIG. 7, and in detail in FIG. 8 of the incorporated application, is called by module PGLOGC to start the speed pattern. When module PGINIT is called by PGLOGC, PGINIT is entered at 210 and step 212 looks at the present location of the elevator car in RAM 86, with its present location being indicated by POS16. Step 212 stores the value of POS16 in RAM 86 at a location STPOS. Location STPOS thus records the position of the elevator car at the start of the run. Step 212 also enables the time ramp generator module PGTRMP by setting flag TREN, and it requests rated acceleration by setting the desired acceleration ADES equal to a. Module PGINIT sets flag ACCEL in step 252, so module PGLOGC will call the acceleration module PGACC the next time it runs. PGINIT exits at 254.

FIG. 8 is a flow chart of module PGACC. Module PGACC is entered at its starting address at 280, and step 286 checks TARGET RAM 86 to see if the AVP floor is the target floor. If it is not the target floor, step 288 checks to see if VPAT has reached the speed value of $V_{FS}-K$. If it has not, then the acceleration phase may continue and step 290 jumps to module PGINIT to update the AVP floor.

If step 286 finds the AVP floor is the target floor, it goes to step 292 which sets a flag DEC. Flag DEC is used by the floor selector for such things as controlling the hall lanterns and the call resets. Step 292 proceeds to program point PGAC02. If step 288 finds VPAT has reached rated speed, step 294 sets a flag FS, which may also be used by the floor selector, and step 294 proceeds to program point PGAC02. Step 166 of module PGLOGC also proceeds to this point. Point PGAC02 proceeds to step 296 which resets the flag ACCEL, it sets flag MIDRN, it sets the desired acceleration rate ADES to zero, and it calculates the slowdown distance SLDN.

Figure 9:
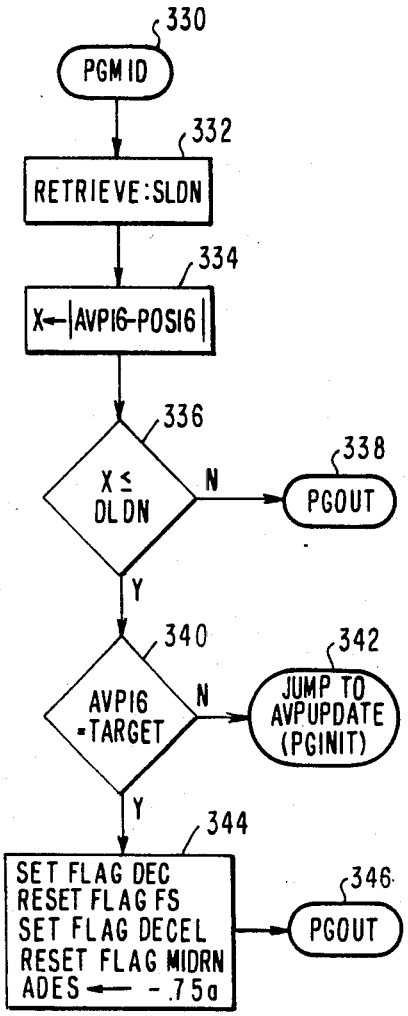
FIG. 9 is a flow chart of a function module PGMID which is called by module PGLOGC to determine when the slowdown phase of the run should start.

Since flag MIDRN is now set, PGLOGC transfers control to module PGMID shown in FIG. 9 the next time it runs. Module PGMID is entered at 330 and step 332 fetches the distance SLDN calculated in step 296 of PGACC. Step 334 determines the distance from the current car position POS16 to the address AVP16 of the AVP floor. Step 336 compares this distance with the distance SLDN. If the car has not reached the slowdown distance for the AVP floor, the program exits at 338. When step 336 finds the car has reached the distance SLDN from the AVP floor, step 340 checks TARGET RAM 86 to see if the AVP floor is the target floor. If it is not the target floor, step 342 jumps to module PGINIT to update the AVP floor. When step 340 finds the car has arrived at the distance SLDN from the target floor, step 344 sets flag DEC, it resets flag FS, it resets flag MIDRN, it sets flag DECEL, and it sets the desired acceleration ADES to −0.75a. Thus, when module PGLOGC runs again, it will transfer control to module PGDEC.

Figure 10:
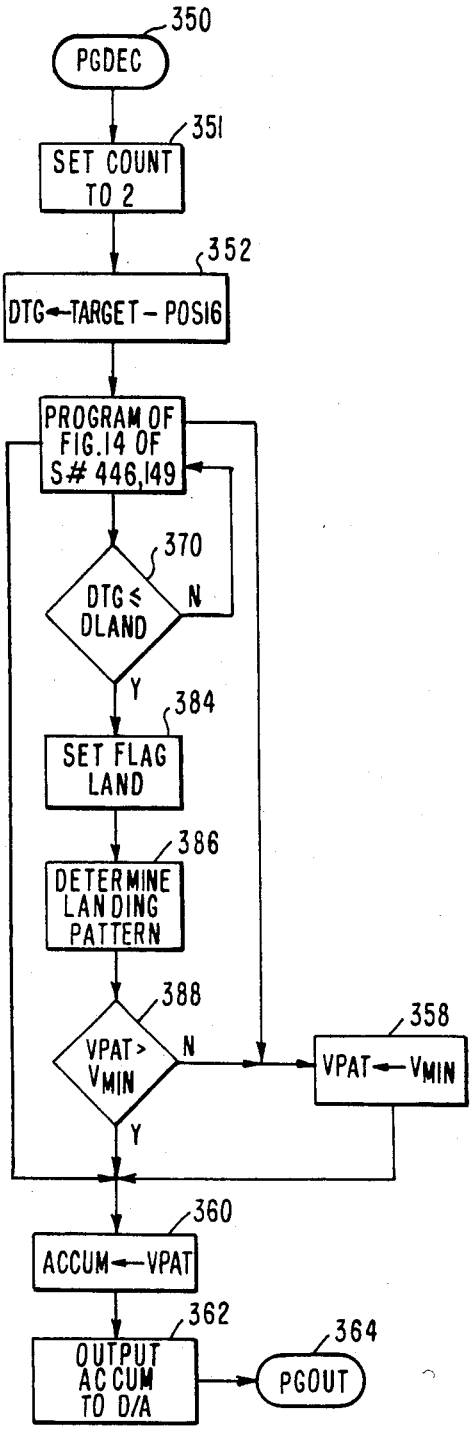
FIG. 10 is a flow chart of a function module PGDEC which is called by module PGLOGC to generate a distance based portion of the speed pattern using the distance-to-go (DTG) in the calculations.

Module PGDEC, shown in FIG. 10 and in detail in FIG. 14 of the incorporated application, is entered at point 350 and step 351 sets COUNT to 2, to now run module PGLOGC every second interrupt. Step 352 determines the distance-to-go (DTG) from the current position of the elevator car POS16 to the address AVP16 of the AVP floor. Step 370 checks to see if the car is within the landing distance DLAND, from the level of the target floor. If it is not within the landing distance, the program determines the digital value $V_{SD}$ of the desired speed pattern at this point, using the value of the distance-to-go (DTG).

When step 370 finds the distance-to-go (DTG) has reached the landing distance DLAND, the program proceeds to step 384 which sets flag LAND for use by an external program which may be called after a predetermined period of time sufficient for the car to reach floor level. Step 384 then proceeds to step 386. As will be hereinafter explained, step 386 provides a value for the landing pattern based upon the distance of the car from floor level.

Figure 3A:
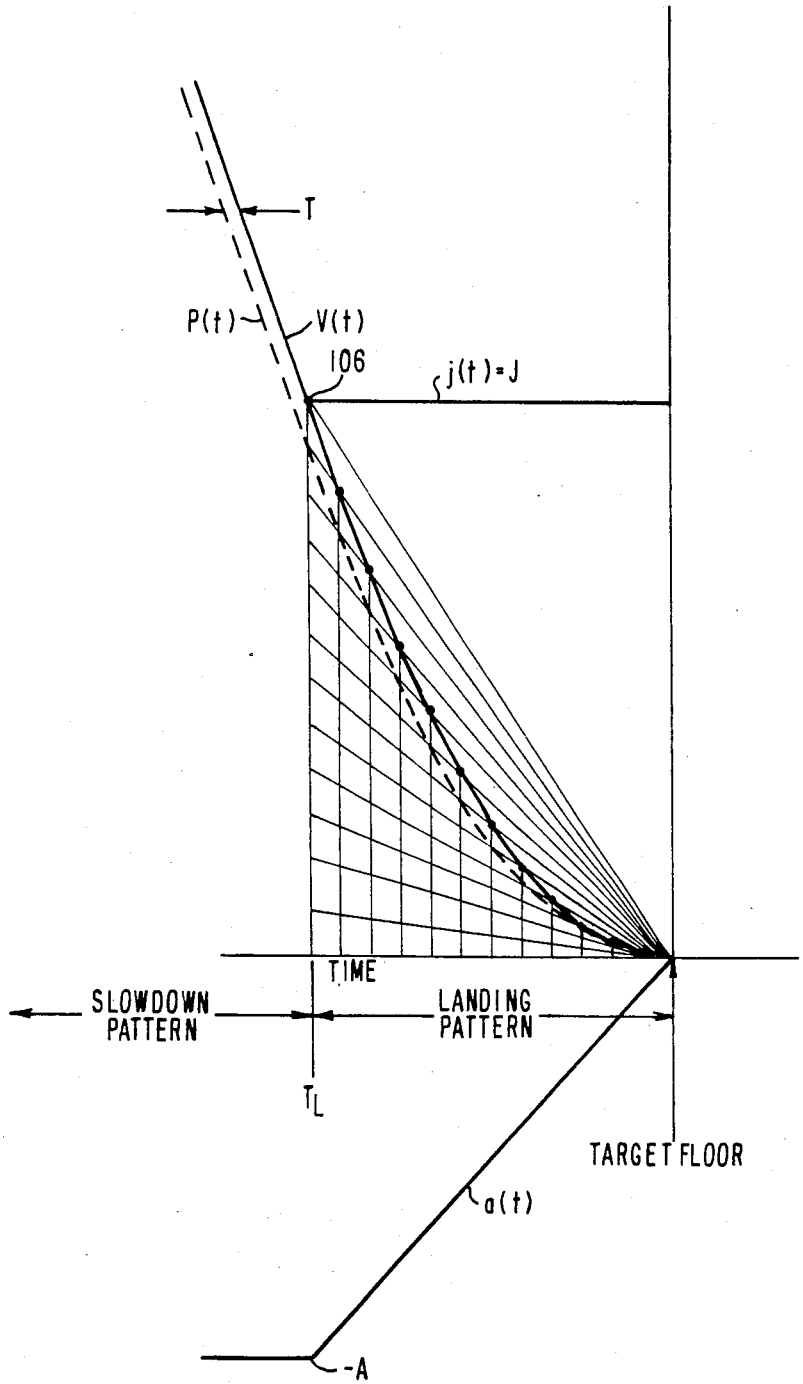
FIG. 3A is an enlarged fragmentary view of FIG. 3, illustrating a landing pattern and actual car landing velocity according to the teachings of the invention.
Figure 3B:
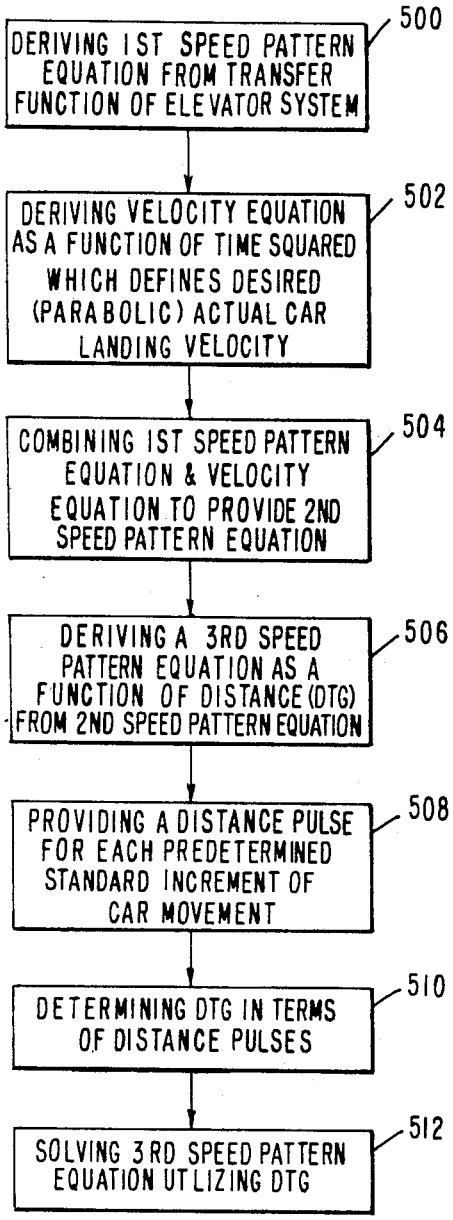
FIG. 3B sets forth the steps of a method of providing a landing speed pattern according to the teachings of the invention.

FIG. 3B sets forth the steps of developing a landing pattern according to the teachings of the invention, for use in step 384. In the first step 500, the actual characteristic of the elevator system the landing pattern is to be used with is utilized to develop a first speed pattern equation. The closed loop quadratic transfer function of a traction elevator system may be expressed as:

$$G(s) = \frac{1}{\frac{s^2}{\omega^2} + \frac{2\zeta}{\omega} s + 1} \tag{3}$$

where:

$\Omega$=natural frequency of the elevator system $\zeta$=damping ratio of the elevator system.

Thus, in block form:

$$P(s) \longrightarrow \boxed{\frac{1}{\frac{s^2}{\omega^2} + \frac{2\zeta}{\omega} s + 1}} \longrightarrow v(s) \tag{4}$$

where:

P(s)=input speed pattern v(s)=actual car velocity.

The system time delay T to a ramp input is related to the natural frequency $\Omega$ and the damping ratio $\zeta$ as follows:

$$T = \frac{2\zeta}{\omega} \tag{5}$$

The present invention develops the landing speed pattern from the desired actual car speed. From equation (4):

$$\frac{P(s)}{\frac{s^2}{\omega^2} + \frac{2\zeta}{\omega} s + 1} = v(s) \tag{6}$$

$$P(s) = v(s)\left[\frac{s^2}{\omega^2} + \frac{2\zeta}{\omega} s + 1\right] \tag{6A}$$

$$P(s) = \frac{s^2}{\omega^2} v(s) + \frac{2\zeta}{\omega} sv(s) + v(s) \tag{6B}$$

Changing from the (s) plane to time:

$$P(t) = \frac{1}{\omega^2} \frac{d^2v}{dt^2} + \frac{2\zeta}{\omega} \frac{dv}{dt} + v(t) \tag{7}$$

Since the second derivative of velocity ($d^2v/dt^2$) is equal to jerk J as a function of time, $2\zeta/\Omega$ is equal to T, as set forth in equation (5), and the first derivative of velocity (dv/dt) is equal to acceleration a as a function of time, equation (7) may be written:

$$P(t) = \frac{1}{\omega^2} j(t) + Ta(t) + v(t) \tag{7A}$$

Equation (7A), which is the first speed pattern equation referred to in step 500, enables the generation of the correct pattern for any given desired actual landing speed characteristic.

According to the teachings of the invention, as set forth in step 502 of FIG. 3B, the actual desired landing pattern characteristic is one in which the actual velocity profile is parabolic. The parabolic landing overcomes all of the disadvantages hereinbefore pointed out relative to the exponential landing. With the parabolic landing, the landing time is significantly reduced because the landing distance is substantially shorter. The final speed and the acceleration reach zero at the floor level with the parabolic landing, and there is no large jerk at the transition between the slowdown and landing patterns.

The correct landing pattern for producing a parabolic actual car landing velocity is derived from equation (7A). The next step in this derivation, as set forth in step 502, is to derive a velocity equation which defines the desired actual car landing velocity.

Initial Condition:

$$a(t) = -A$$

where:

a(t)=initial deceleration

−A=maximum deceleration rate.

Final Conditions:

$$a=0$$

$$v=0$$

$$x=0$$

where:

a=deceleration v=velocity x=distance-to-go (DTG).

System Constraints:

J=maximum jerk

−A=maximum deceleration rate.

Starting with the premise that the system should land with a constant jerk rate at the maximum jerk rate J allowed for the system, which will insure as rapid a landing as possible consistent with passenger comfort, the following relationships may be established by integration:

$$j(t) = J \tag{8A}$$

$$a(t) = Jt \tag{8B}$$

$$v(t) = \frac{Jt^2}{2} \tag{8C}$$

$$x(t) = \frac{Jt^3}{6} \tag{8D}$$

Equation (8D) may also be written as:

$$t = \left(\frac{6x}{J}\right)^{\frac{1}{3}} \tag{8E}$$

At the initial conditions of $t=T_L$; $a=-A=Jt$, acceleration can be expressed as the integral of jerk:

$$a(t) = \int_{T_L}^{0} J\,dt \tag{9}$$

$$a(t) = -Jt \tag{9A}$$

Therefore, the time $T_L$ to land ($t=T_L$) is:

$$T_L = \frac{A}{J} \tag{10}$$

Since velocity is the integral of acceleration, the velocity may be expressed as:

$$v(t) = \int_{t}^{0} a(t)\,dt \tag{11}$$

substituting equation (9A) into equation (11) gives the following:

$$v(t) = \int_{t}^{0} -Jt\,dt \tag{12}$$

$$v(t) = \frac{Jt^2}{2} \tag{12A}$$

Equation (12A) is the desired parabolic landing speed, i.e., the actual velocity is a function of time squared, which defines a parabolic profile. Equation (12A) is the velocity equation referred to in step 502.

Since the distance x is the integral of velocity, the distance may be expressed as:

$$x(t) = \int_{t}^{0} v(t)\,dt \tag{13}$$

Substituting the desired velocity from equation (12A) into equation (13) gives:

$$x(t) = \int_{t}^{0} \frac{Jt^2}{2} \tag{14}$$

$$x(t) = \frac{-Jt^3}{6} \tag{15}$$

The total landing distance, used for DLAND, when t starts at $T_L$ is:

$$x_{TOTAL} = \frac{JT_L^3}{6} \tag{16}$$

Since time $T_L$ to land is equal to A/J, as set forth in equation (10):

$$x_{TOTAL} = \frac{A^3}{6J^2} \tag{17}$$

As set forth in step 504, the landing pattern which will cause the landing speed to be parabolic may be determined by incorporating the desired velocity as set forth in equation (12A) into equation (7A). As hereinbefore stated, equation (7A) is the equation which enables the generation of the correct pattern for any desired landing characteristic. Performing this substitution provides:

$$P(t) = \frac{J(t)}{\omega^2} + Ta(t) + \frac{Jt^2}{2} \tag{18}$$

Equation (18) is the second speed pattern equation of step 504. In the preferred embodiment of the invention, the landing pattern is generated as a function of distance x, instead of as a function of time t. To accomplish the transformation from time to distance, as set forth in step 506, equation (18) is first written in terms of J, as follows, using equations (9A) and (12A):

$$P(t) = \frac{J(t)}{\omega^2} - TJt + \frac{Jt^2}{2} \tag{19}$$

From equations (5) and (8A), equation (19) may be written:

$$P(t) = \left(\frac{T}{2\zeta}\right)^2 J - TJt + \frac{Jt^2}{2} \tag{20}$$

From equation (8D), time t as a function of distance x is provided by the expression:

$$t = \left(\frac{6x}{J}\right)^{\frac{1}{3}}.$$

Thus, the landing pattern P as a function of x is:

$$P(x) = \left(\frac{T}{2\zeta}\right)^2 J - TJ\left(\frac{6x}{J}\right)^{\frac{1}{3}} + \frac{J}{2}\left(\frac{6x}{J}\right)^{\frac{2}{3}} \tag{21}$$

since $$TJ\left(\frac{6x}{J}\right)^{\frac{1}{3}}$$

is equal to $T6^{\frac{1}{3}}x^{\frac{1}{3}}J^{\frac{2}{3}}$, and $$\frac{J}{2}\left(\frac{6x}{J}\right)^{\frac{2}{3}}$$

is equal to $(4.5)^{\frac{1}{3}}J^{\frac{1}{3}}x^{\frac{2}{3}}$, equation (21) may be written:

$$P(x) = \left(\frac{T}{2\zeta}\right)^2 J - T6^{\frac{1}{3}}x^{\frac{1}{3}}J^{\frac{2}{3}} + (4.5)^{\frac{1}{3}}J^{\frac{1}{3}}x^{\frac{2}{3}} \tag{22}$$

If the pattern P(x) is in FPM, the time delay T is in seconds, the maximum jerk J is in ft/sec$^3$ and x is a count, such as a count in the terms of $\frac{1}{4}$ inch increments, equation (22) may be written:

$$P(x) = \left(\frac{T}{2\zeta}\right)^2 60J - 6^{\frac{1}{3}}TJ^{\frac{2}{3}}x^{\frac{1}{3}}\frac{60}{48^{\frac{1}{3}}} + \frac{60}{48^{\frac{2}{3}}}(4.5)^{\frac{1}{3}}J^{\frac{1}{3}}x^{\frac{2}{3}} \tag{23}$$

or $$P(x) = \left(\frac{T}{2\zeta}\right)^2 60J - TJ^{\frac{2}{3}}30x^{\frac{1}{3}} + J^{\frac{1}{3}}7.5x^{\frac{2}{3}} \tag{24}$$

If we let:

$$K_1 = 7.5J^{\frac{1}{3}}$$

$$K_2 = \left(\frac{T}{2\zeta}\right)^2 60J$$

$$K_3 = 30TJ^{\frac{2}{3}}$$

then, equation (24) may be written:

$$P(x) = K_1x^{\frac{2}{3}} + K_2 - K_3x^{\frac{1}{3}} \tag{25}$$

Equation (25) defines a landing speed pattern as a function of the distance x to go to the target floor (DTG), which will cause the actual landing velocity v to have a parabolic profile, as shown in FIG. 3A. This is the third speed pattern equation mentioned in step 506.

Equation (25) may be implemented in any suitable manner using the distance pulses PLSINT to determine the distance-to-go DTG, as set forth in steps 508 and 510. The implementation involves solving equation (25) utilizing DTG, as set forth in step 512. For example, it may be used to calculate the landing pattern value for each 0.25 inch increment from distance DLAND to the target floor, with each such value being stored in a look-up table, such as set forth in the ROM map of FIG. 4. For example, if DLAND is ten inches, the DTG count of forty 0.25 inch increments would be 00101000 when the car reaches the landing distance from the target floor. This DTG count is used to address ROM 88, and the contents stored at this address of ROM 88 would be the binary value of the landing pattern calculated from equation (25), using the value of forty for x. In this embodiment, step 386 would include the steps set forth in FIG. 11.

Figure 11:
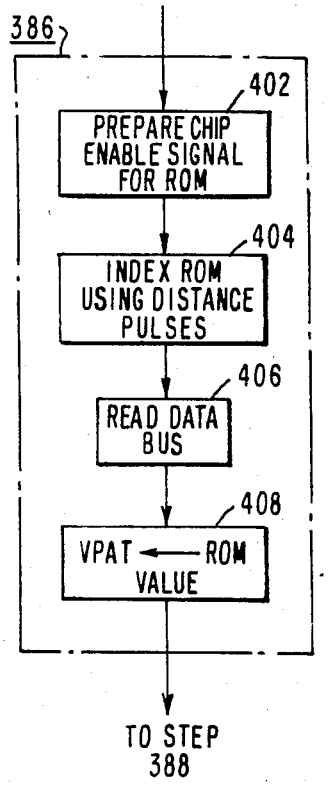
FIG. 11 is a flow chart which sets forth steps for determining the landing speed pattern from a read-only memory (ROM)

Step 402 of FIG. 11 prepares the appropriate chip enable signal for reading ROM 88. Step 404 addresses ROM 88 using the digital value of the DTG count, ROM 88 outputs the pattern value stored at this address, step 406 reads the data bus, and step 408 stores the pattern value at a location in RAM indicated as VPAT.

An alternative arrangement for implementing equation (25) includes calculating the landing pattern each time a new distance pulse updates the DTG count. The constants $K_1$, $K_2$, and $K_3$ would be stored in ROM 88, as shown in the ROM map of FIG. 4. In this embodiment, step 386 would include the steps set forth in FIG. 12, which steps implement equation (25).

Figure 12:
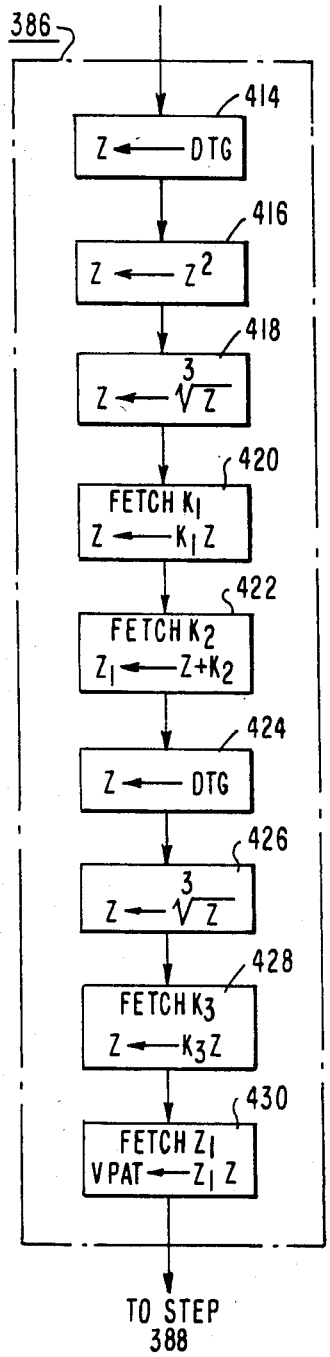
FIG. 12 is a flow chart which sets forth steps for calculating the landing speed pattern from the DTG.

More specifically, as set forth in in FIG. 12, the DTG value determined in step 352 is stored by step 414 at a location Z in RAM 86. Step 416 squares the value stored at Z, and stores the squared value at location Z. Step 418 takes the cube root of the value now stored at location Z and stores the result at Z. Step 420 fetches the constant $K_1$ from ROM 88, it multiplies $K_1$ by the value stored at location Z, and it stores the result at Z.

Step 422 fetches the constant $K_2$ from ROM 88, it adds $K_2$ to the value stored at location Z, and it stores the result at a location $Z_1$. Step 424 stores the DTG count at location Z, step 426 takes the cube root of the value stored at Z, and it stores the result at location Z. Step 428 fetches the constant $K_3$ from ROM 88, it multiplies it by the value stored at location Z, and it stores the result at location Z. Step 430 fetches the value previously stored at location $Z_1$, and it subtracts the value stored at location Z from the value stored at location $Z_1$. Step 430 stores the result in location VPAT of RAM 86, and it then proceeds to step 388.

In summary, there has been disclosed new and improved methods and apparatus for generating a landing speed pattern which overcomes the disadvantages of prior art exponential speed pattern systems. The present invention overcomes the disadvantages of the prior art by generating a landing speed pattern which causes the elevator system to respond with a landing velocity having a parabolic profile. The landing is made in a shorter distance and in about one second less time than systems which use an exponential landing pattern, and unlike exponential systems, the car velocity, car acceleration and jerk all reach zero at the floor level of the target floor.

We claim as our invention:

1. A method of generating a landing speed pattern for use in stopping an elevator car at a target floor, comprising the steps of:

deriving a first speed pattern equation from the closed loop transfer function of the elevator system the elevator car is associated with, deriving a velocity equation which defines the desired actual car landing velocity, combining the first speed pattern equation and the velocity equation to provide a second speed pattern equation, and implementing said second speed pattern equation to provide a landing speed pattern.

2. The method of claim 1 wherein the step which provides the second speed pattern equation provides the pattern signal as a function of time, and wherein the step of implementing the second speed pattern equation includes the step of deriving a third speed pattern equation from the second speed pattern equation, with the third speed pattern equation being a function of the distance-to-go (DTG) from the elevator car to the target floor.

3. The method of claim 2 including the steps of providing a distance pulse in response to each predetermined standard increment of movement of the elevator car, determining the DTG in terms of a count of said distance pulses, and wherein the step of implementing the speed pattern includes the step of utilizing the DTG count.

4. The method of claim 3 wherein the step of utilizing the DTG count includes the steps of programming a read-only memory (ROM) to provide a look-up table of values obtained from the third speed pattern equation, and indexing the ROM with the distance pulses.

5. The method of claim 3 wherein the step of utilizing the DTG count includes the step of periodically solving the third speed pattern equation using the current DTG count.

6. The method of claim 1 wherein the step of deriving the velocity equation provides an equation in which the actual velocity is a function of time squared.

7. A landing speed pattern generator for use by an elevator car as it stops at a target floor, comprising:

means responsive to movement of the elevator car for providing distance pulses, means responsive to the distance pulses for providing a quantity indicative of the distance-to-go (DTG) from the elevator car to the target floor, and means providing a speed pattern signal according to the speed pattern equation $$K_1x^{\frac{2}{3}}+K_2-K_3x^{\frac{1}{3}},$$

wherein x is responsive to the DTG quantity and $K_1$, $K_2$, and $K_3$ are constants.

8. The landing speed pattern generator of claim 7 wherein the means which provides the speed pattern signal includes a read-only memory programmed according to the speed pattern equation for different values of the DTG quantity, and means for indexing said read-only memory in response to the distance pulses.

9. The landing speed pattern generator of claim 7 wherein the means which provides the speed pattern signal includes means for periodically calculating the speed pattern from the speed pattern equation, using the current DTG quantity.

10. The landing speed pattern generator of claim 7 wherein the means which provides the DTC quantity provides the DTG quantity in terms of a count of the distance pulses.

* * * * *